US006003245A

United States Patent [19]

Lipponen et al.

[11] Patent Number: 6,003,245

[45] Date of Patent: Dec. 21, 1999

[54] METHOD FOR OPTIMIZING OF EVAPORATION DRYING OF PAPER, RUNNABILITY, AND OF PAPER QUALITY AS WELL AS DRYER SECTION THAT MAKES USE OF THE METHOD IN A PAPER MACHINE

[75] Inventors: Juha Lipponen, Palokka; Martti Salminen; Juha Kaihovirta, both of Jyväskylä; Reima Kerttula, Muurame, all of Finland

[73] Assignee: Valmet Corporation, Helsinki, Finland

[21] Appl. No.: 09/064,660

[22] Filed: Apr. 22, 1998

Related U.S. Application Data

[60] Provisional application No. 60/044,986, Apr. 28, 1997.

[30] Foreign Application Priority Data

Apr. 22, 1997 [FI] Finland ..... 971714

[51] Int. Cl.[6] ..... F26B 3/00

[52] U.S. Cl. ..... 34/457; 34/454; 34/117

[58] Field of Search ..... 34/114, 115, 116, 34/117, 120, 123, 454, 457; 162/207, 290, 359.1, 375

[56] References Cited

U.S. PATENT DOCUMENTS

| | | | |
|---|---|---|---|
| 3,301,746 | 1/1967 | Sanford et al. | 162/113 |
| 3,418,723 | 12/1968 | Burgess et al. | 34/1 |
| 3,447,247 | 6/1969 | Daane | 34/122 |
| 3,541,697 | 11/1970 | Villalobos | 34/115 |
| 3,816,941 | 6/1974 | Holik et al. | 34/116 |
| 3,956,832 | 5/1976 | Justus | 34/115 |
| 4,033,048 | 7/1977 | Van Ike | 34/92 |
| 4,033,049 | 7/1977 | Schiel et al. | 34/115 |
| 4,064,637 | 12/1977 | Lindgren | 34/122 |
| 4,882,855 | 11/1989 | Loser et al. | 34/116 |
| 4,982,513 | 1/1991 | Loser et al. | 34/116 |
| 5,009,016 | 4/1991 | LePisto et al. | 34/41 |
| 5,383,288 | 1/1995 | Ilmarinen | 34/392 |
| 5,495,678 | 3/1996 | Ilmarinen et al. | 34/117 |
| 5,553,393 | 9/1996 | Korhonen et al. | 34/117 |

FOREIGN PATENT DOCUMENTS

| | | |
|---|---|---|
| 2061976 | 9/1992 | Canada . |
| 96/32534 | 10/1996 | WIPO . |

*Primary Examiner*—Pamela A. Wilson
*Attorney, Agent, or Firm*—Steinberg & Raskin, P.C.

[57] ABSTRACT

A method and arrangement for evaporation drying of a paper web in which the web is dried in three successive stages I, II and III that are carried out in the direction of progress of the web as follows: in the first stage (I), the web is heated in a short section in the machine direction quickly to a temperature of 55° C. to 85° C. minimizing web breaks of the relatively moist and weak web, after the first stage (I), the main evaporation drying of the web is carried out so that the evaporation efficiency and the rate of increase in the dry solids content of the web are substantially higher than in the first stage or in the final stage (III), and the web temperature does not substantially rise while the drying proceeds, and in the final stage (III), the drying is continued with a decreasing evaporation efficiency and an average rate of increase in the dry solids content of the web in the machine direction which is lower than in the preceding stage (II) but higher than in a conventional cylinder drying with single-wire draw so that the paper quality is controlled at the same time.

20 Claims, 8 Drawing Sheets

METHOD FOR OPTIMIZING OF EVAPORATION DRYING OF PAPER, RUNNABILITY, AND OF PAPER QUALITY AS WELL AS DRYER SECTION THAT MAKES USE OF THE METHOD IN A PAPER MACHINE

This application claims the benefit of U.S. Provisional Application No. 60/044,986.

FIELD OF THE INVENTION

The present invention relates to a method for evaporation drying of a paper web that comes from a press section of a paper machine from a dry solids content ko from about 35% to about 55% to a dry solids content k1 from about 90% to about 98%.

Also, the present invention relates to a dryer section of a paper machine for carrying out the method.

BACKGROUND OF THE INVENTION

In the prior art, in multi-cylinder dryers of paper machines, twin-wire draw and/or single-wire draw is/are employed. When employing twin-wire draw, a group of drying cylinders comprises two closed (endless) wires, fabrics or belts which press the web one from above and the other one from below against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls between the drying cylinders, the web remains at the side of the outside curve and is subjected to negative pressure as it runs over the reversing cylinders in order to maintain the web on the wire. Thus, in single-wire draw, the drying cylinders are arranged outside the wire loop, and the reversing cylinders or rolls are arranged inside the wire loop.

In the prior art, dryer sections are known that comprise only so-called normal groups with single-wire draw in which drying cylinders are situated in an upper row and reversing cylinders or rolls are situated in a lower row below the row of drying cylinders.

The highest web speeds in paper machines are today up to an order of about 25 meters per second and slightly higher, but before long, a web running speed in the range of 25–40 meters per second (mps) will be commonly used. In such a case, a bottleneck for the runnability of a paper machine will be the dryer section, whose length with prior art multi-cylinder dryers would also become intolerably long. If it is imagined that a present day multi-cylinder dryer were used in a newsprint machine at a web speed of about 40 mps, it would include about 70 drying cylinders ($\phi \approx 1800$ mm), and its length in the machine direction would be about 180 meters. In such a case, the dryer section would comprise about 15 separate wire groups and a corresponding number of draws over group gaps. It is probable that, in a speed range of 30–40 mps, the runnability of normal prior art multi-cylinder dryers is no longer even nearly satisfactory, but web breaks would occur quite often lowering the efficiency of the paper machine.

In a speed range of 30–40 mps and at higher speeds, the prior art multi-cylinder dryers would also become uneconomical because the cost of investment of an excessively long paper machine hall would become unreasonably high. It can be estimated that the cost of a paper machine hall is at present typically about 1 million FIM per meter in the machine direction.

It is known in the prior art to use various ventilation/impingement-drying/through-drying units for evaporation drying of a paper web, which units have been employed in particular in the drying of tissue paper. With respect to this prior art, reference is made, by way of example, to the following patent literature: U.S. Pat. Nos. 3,301,746, 3,418,723, 3,447,247, 3,541,697, 3,956,832 and 4,033,048, Canadian Patent No. 2,061,976, West German Patent Application Nos. DE-A-22 12 209 (corresponding to U.S. Pat. No. 3,816,941) and DE-A-23 64 346 (corresponding to U.S. Pat. No. 4,033,049), European Patent Application No. EP-A2-0 427 218, Finnish Patent Nos. 83,679, 57,457 (corresponding to Swedish Patent Application No. 7503134-4) and 87,669 (corresponding to U.S. Pat. No. 5,383,288), and Finnish Patent Application No. 931263 (corresponding to U.S. Pat. No. 5,495,678 and European Patent Application No. 0 620 313-A1).

OBJECTS AND SUMMARY OF THE INVENTION

An object of the invention is, in connection with increasing of paper machine speeds and with modernizations, to permit placement of a new dryer section in the place of an existing multi-cylinder dryer.

In relation to this, it is a further object of the invention to provide a dryer section concept that permits ever shorter dryer sections compared with prior art dryer sections.

It is a further object of the invention to make it possible to provide a dryer section concept in which different evaporation devices and techniques can be applied optimally in the different stages of drying so that a short construction of the dryer section, a good quality of the paper and a runnability sufficiently free from disturbance are achieved.

Another important object of the present invention is to provide novel drying modules for a paper web and dryer sections that make use of such modules, which are suitable for use at high web speeds greater than about 25 meters per second, which speeds can be up to an order of from about 30 to about 40 meters per second or even higher.

It is a further object of the present invention to increase the drying capacity by means of impingement drying and/or through drying and in this way, to make the length of the dryer section shorter, which contributes to an improvement of the runnability of the dryer section.

It is a further object of the invention to provide such a drying method and drying equipment by whose means, in the above-mentioned high speed range, the length of the dryer section in the machine direction can, nevertheless, become reasonable so that its length does not substantially exceed the length of the cylinder dryers currently in operation. An achievement of this objective would permit renewals and modernizations of paper machines in existing paper machine halls up to, and even beyond, a web speed of about 40 meters per second.

It is a further object of the invention to provide a drying method and a dryer section that applies the same wherein the web is reliably affixed to the drying wire over substantially the entire length of the dryer section so that cross-direction shrinkage of the web can be substantially prevented.

It is a further object of the present invention to provide a drying method and a dryer section that applies the same wherein the web is prevented from sticking to the cylinders in the initial end of the dryer section and thereby improving both the paper quality and the runnability of the paper machine.

With respect to the prior art most closely related to the present invention, reference is made to the current assignee's Finnish Patent 93,876 (corresponding to U.S. Pat. No. 5,553,393) in which a dryer section of a paper machine is described which is comprised of cylinder groups with single-wire draw. In this dryer section, it is considered a novel feature that, in view of optimizing the drying capacity calculated per unit of length of the dryer section in the machine direction, as the drying makes progress, different ratios k=D/d of the drying-cylinder diameter D to the reversing-roll diameter d are employed. Accordingly, in the first group or groups in the initial end of the dryer section, the ratio k=k1 is higher than the ratio k=k2 in the groups in the middle area of the dryer section, k1>k2, and that in the group or groups in the final end of the dryer section, a diameter ratio k3 is used that is higher than the ratio k2, k3>k2. In this Finnish patent, an effort has been made to select the diameter ratio D/d of drying cylinder to reversing roll optimally taking into account the different evaporation curves that are carried into effect in different areas of the dryer section. Further, in the initial end of the dryer section, preferably in one group, the diameter ratio D/d that is used is higher than average, compared with the middle area of the dryer section, for example in the second, third and fourth wire groups. The last mentioned wire groups are in the area where the main evaporation of water takes place from the web. The higher diameter ratio D/d is also employed in the final end of the dryer section, in which a significant proportion of the evaporation takes place on the curve sectors of the wire and the web on the drying cylinders.

In FI 93876, owing to the optimally chosen and varied diameter ratio k=D/d of drying cylinder to reversing roll, the length of the drying section is estimated to be shortened, at the maximum, by about 10 percent in comparison with a situation in which the ratio k is invariable over the entire length of the dryer section. It has been understood in FI 93876 that, as the drying proceeds, the nature of the drying process will change substantially. However, only the diameter ratio of the drying cylinder to the reversing roll, k=D/d, has been varied in order to optimize the drying, which does, however, not take it far enough from the point of view of optimizing the drying process and the drying configuration, especially since the speeds of paper machines become ever higher and the quality requirements imposed on the paper become ever stricter.

In view of the foregoing, another object of the present invention is further development of the evaporation drying and the dryer sections in paper machines so that the drying process in different parts of the dryer section, in different phases of the drying process, and the dryer section configuration can be optimized and the length of the dryer section shortened or kept unchanged while the speeds become higher.

It is a further object of the invention to optimize the runnability of the paper machine in different phases of the drying procedure so that the efficiency of the paper machine is improved while breaks are fewer.

A further object of the invention to take advantage of the different structures/methods/processes in the different phases of the paper drying process so that the quality properties of the paper can be optimized.

The nature of the drying procedure has been clarified further in the current assignee's recent research and in dryer sections that are in operation and in test runs on a test device. The invention is partly based on the observation that in the dryer section of a paper machine, the drying process can be divided into three process stages that are different from each other:

(I) heating stage, in which evaporation does not take place to a substantial extent, but the water present in the web is mainly heated;

(II) main evaporation area, in which the rate of evaporation remains substantially invariable when cylinder drying alone is used and in which the main evaporation of water from between the fibers and from their surface takes place, and (III) final evaporation area, in which the rate of evaporation becomes lower and the proportion of the evaporation that takes place on the drying cylinders is increased, and in this stage mainly evaporation of water present inside the fibers takes place.

It has also been a problem in prior art multi-cylinder dryers that in the first stage (I), it has not been possible to use a temperature high enough in view of optimizing the drying because, when the paper web is in direct contact with the hot faces of the drying cylinders, at temperatures higher than a certain degree, sticking of the web to the hot surface of the cylinder occurs, from which web breaks and standstills follow. It has been noticed that excessively hot contact drying cylinders also have detrimental effects on the quality properties of the paper.

An object of the present invention is therefore further development of the prior art, elimination of drawbacks of the prior art that were mentioned above and those discussed below, and implementation of other objectives of the invention.

In view of achieving the above objects, the method of the invention comprises three successive stages I, II and III that are carried out in the direction of progress of the web in the sequence given as follows:

I. in the first stage, the paper web coming from the press section of the paper machine is heated in a short section of the paper machine in the machine direction quickly to a temperature of about 55° C. to about 85° C., preferably to a temperature of about 70° C., and in this section the web is passed so that web breaks of the relatively moist and weak web are minimized;

II. after the first stage I, in this second stage II the main evaporation drying of the web is carried out with such an evaporation efficiency and rate of increase in dry solids content per unit of length of the dryer section in the machine direction that said evaporation efficiency and rate of increase in dry solids content of the web are substantially higher than in the first stage or in the final stage III, and the web temperature does substantially not rise in the second stage while the drying proceeds;

III. in the third and final stage, the drying is continued with a decreasing evaporation efficiency and with such an average rate of increase in the dry solids content of the web in the machine direction as is lower than in the preceding stage II but higher than in a conventional cylinder drying with single-wire draw so that the paper quality can be controlled at the same time.

In the dryer section in accordance with the invention situated after the press section of the paper machine, the dryer section comprises the following dryer units that are placed in the given sequence in the machine direction:

I. in order to carry out the first stage I of the method, the first unit is a drying wire unit in which the paper web runs past blow boxes and/or radiation dryer units, by whose means the web is heated without a direct contact with heated faces; and II. in order to carry out the second stage II of the method, dryer units that comprise at least one single-wire group with single-wire draw that is open towards the bottom, in which the contact drying cylinders are in an upper row and the reversing suction cylinders are in a lower row so that removal of broke can take place downwards by the effect of gravity.

In the first stage I in the method in accordance with the invention, such a construction of the dryer section is used as also has optimal runnability properties so that in this stage, when the web is still moist and relatively weak, web breaks can be minimized. The final stage III of the method of the invention is carried out with such constructions of equipment which also permit control of quality properties of paper, such as brightness, curl, etc.

With the method in accordance with the present invention and with a dryer section concept that carries out the method, it is possible to achieve the objectives mentioned above and to substantially eliminate the drawbacks of the prior art dryer sections. In accordance with the invention, it is possible to provide a dryer section that is shorter and more compact than in the prior art also at high machine speeds so that the operating quality of the dryer section still remains good.

In the method and the dryer section in accordance with the invention the web is preferably dried so that in the first stage I, the drying energy is at least mainly applied from the side of and through the upper surface of the web, in the second stage II, the drying energy is applied to the web from the side of and through its lower surface, and in the third stage III, the drying energy is applied to the web from and through its both surfaces.

In the method and the dryer section in accordance with the invention, the sufficiently high rate of evaporation required by stages II and/or III is achieved, in a preferred embodiment of the invention, by at the same time employing both impingement drying, wherein drying air is blown directly against the web to be dried, and through-drying taking place by blowing through the drying wire on a cylinder.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
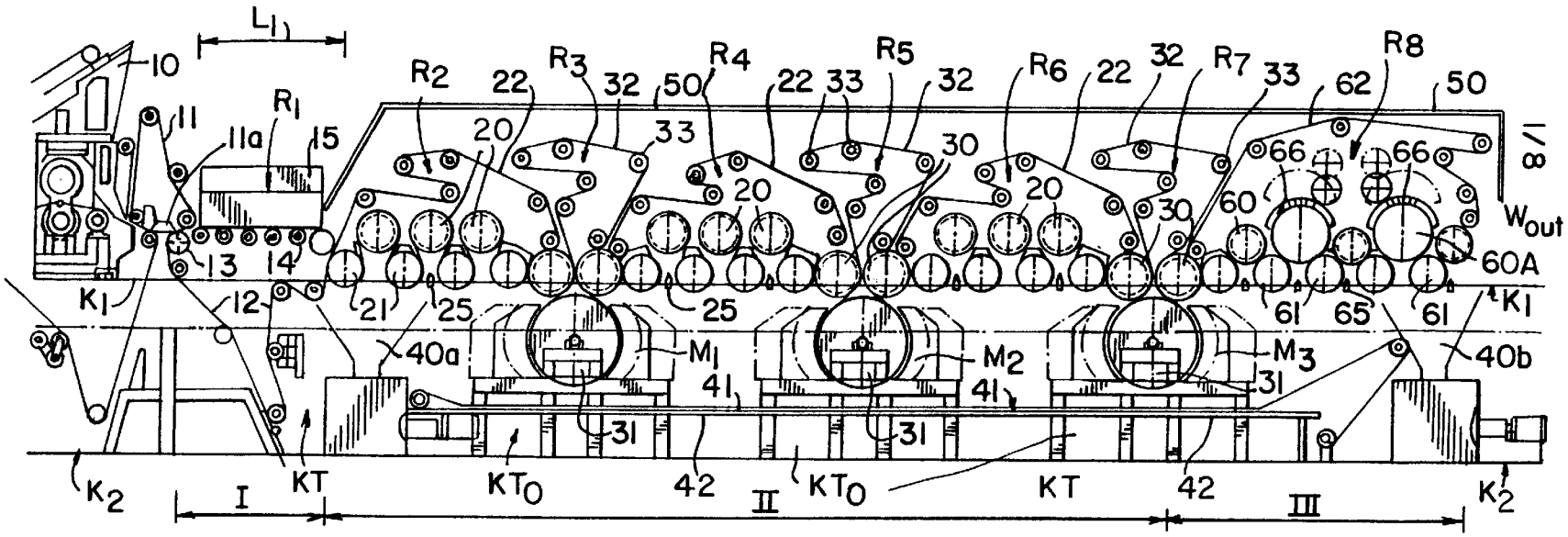
FIG. 1A is a schematic side view of a dryer section in accordance with the invention in which the method in accordance with the invention can be applied.

Referring to FIGS. 1–5 wherein like reference numerals refer to the same or similar elements, FIG. 1A shows a particularly favorable overall concept of a dryer section in accordance with the invention. Specifically, a paper web W is passed from a press section 10 of the paper machine having a dry solids content ko from about 35% to about 55% and a temperature To of from about 30° C. to about 65° C., on the bottom face of a press fabric 11 and supported by a PressRun™ box 11*a* onto the top face of a drying wire 12 over its guide roll 13. A first planar drying unit $R_1$ comprises a blow hood 15, under which the web W to be dried runs on the horizontal run of the wire 12, which is supported by rolls 14. The horizontal run of the wire 12 forms a plane in connection with which grooved rolls and/or suction boxes or blow boxes support the web W. In the unit $R_1$, an intensive drying energy impulse is applied to the top face of the web W, in which connection, after the unit $R_1$, the temperature $T_1$ of the web W is from about 60° C. to about 85° C. In the unit $R_1$, primarily heating of the web W and the water contained in it take place, but no substantial evaporation of water as yet. The length L1 of the unit R1 in the machine direction is typically of an order of from about 3 m to about 10 m.

In the unit $R_1$, the paper web W runs on support of the upper run of the drying wire 12 along a substantially linear path in the horizontal plane so that it has no major directional changes in the machine direction and thus, no high dynamic forces are applied to it which might produce a web break in the web W, which is still relatively moist and has a low strength. In the interior of the blow hood 15, there is a nozzle arrangement by whose means hot drying gases, such as air or steam, are blown against the top face of the web W. Additionally or alternatively, it is possible to employ infrared heaters. The blow devices and/or radiators in the unit $R_1$ can be arranged so that their output in the cross direction of the web W is adjustable so as to provide profiling of the web W in the cross direction.

In FIG. 1A, the unit $R_1$ is followed by the first so-called normal (not inverted) single-wire unit $R_2$ having a drying wire 22 onto which the web W is transferred as a closed draw in the area of a first reversing suction roll 21. The single-wire unit $R_2$, and so also the subsequent single-wire units $R_4$, $R_6$ and $R_8$ that are open towards the bottom comprise steam-heated contact-drying cylinders 20 arranged in an upper row and reversing suction rolls 21 arranged in a lower row, for example the current assignee's VAC-rolls™.

Below the cylinders 20, there are doctors and ventilation blow devices 25. The paper web W to be dried enters into direct contact with the faces of the steam-heated drying cylinders 20, and on the reversing suction rolls 21, the web W remains on the drying wire 22 at the side of the outside curve.

Figure 1B:
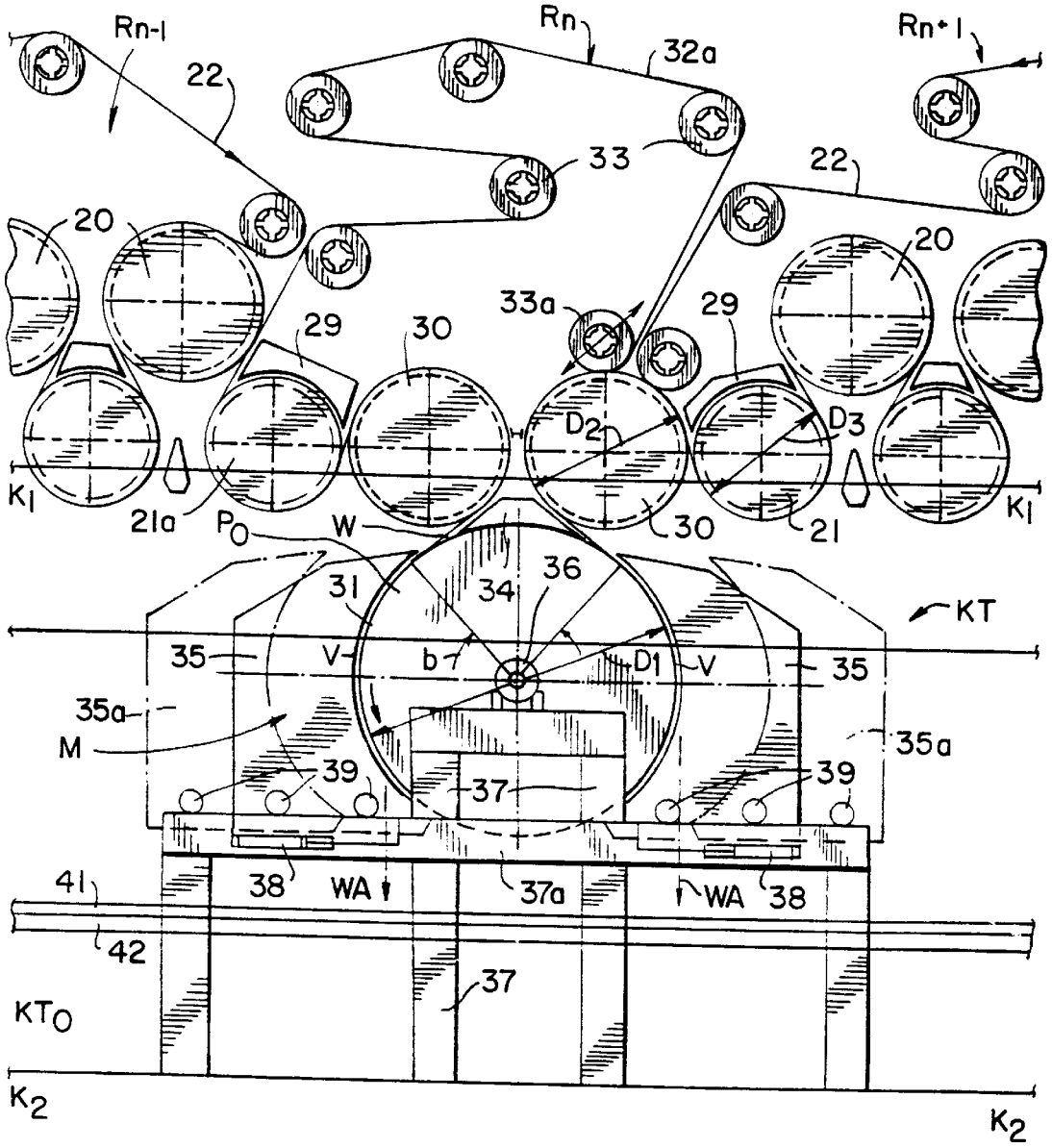
FIG. 1B shows a preferred contact-drying/impingement-drying unit used in a dryer section in accordance with the invention, of which units there are three in the dryer section shown in FIG. 1A, separated from one another by single-wire groups.

In FIG. 1A, after the group $R_2$ with single-wire draw, there follows a drying unit $R_3$ which as shown in FIG. 1B, comprises two contact-drying cylinders 30 and a large-diameter $D_1$ impingement-drying/through-drying cylinder 31 with a perforated mantle, which cylinder will be called a large cylinder in the following. A drying wire 32 is guided by guide rolls 33 to run around the contact-drying cylinders 30 and around the large cylinder 31. The impingement-drying/through-drying hood module $M_1$ of the drying unit $R_3$ is situated in a basement space KT underneath the floor level $K_1$—$K_1$ of the paper machine hall on support of the floor plane or level $K_2$—$K_2$ of this space. The central axes of the contact-drying cylinders 30 in the unit $R_3$ and in the corresponding following drying units $R_5$ and $R_7$ in accordance with the present invention are placed substantially in the floor plane of the paper machine hall or in the vicinity of the plane $K_1$—$K_1$, preferably slightly above this plane. The paper web W to be dried is passed from the single-wire unit $R_2$ as a closed draw onto the first drying cylinder 30 in the drying unit $R_3$ ($R_n$), after which the web W is passed on the wire 32 of the unit $R_3$ over the large cylinder 31 of the first module $M_1$ on a remarkably large sector between about 220° and about 280° on support of the drying wire 32 and further onto the second drying cylinder 30 in the unit $R_3$ ($R_n$). From this drying cylinder 30, the web W is transferred as a closed draw into the next normal unit $R_4$ with single-wire draw, which unit is substantially similar to the unit $R_2$ described above. After this, there follows the second drying unit $R_5$ ($R_n$), which unit is similar to the drying unit $R_3$ described above and whose large cylinder 31 is also placed in the basement space KT. After the drying unit $R_5$, the web W is passed as a closed draw into the next single-wire unit $R_6$, which is followed by a third drying unit $R_7$ ($R_n$) having a large cylinder 31 likewise placed in the basement space KT. The unit $R_7$ is followed by a particular single-wire unit $R_8$, from which the web Wout is passed to a reel-up or into a finishing unit (not shown). The construction and operation of the particular unit $R_8$ will be described in more detail later with reference to FIG. 1C.

In the basement space, besides the modules $M_1$, $M_2$ and $M_3$, FIG. 1A also shows pulpers 40*a* and 40*b*, between which there is a broke conveyor 41, which carries the paper broke into the pulper 40*a* and/or 40*b*. In the event of a web break, the web W can be passed after the unit $R_1$ directly into the pulper 40*a* placed underneath. The single-wire units $R_4$, $R_6$ and $R_8$ are open towards the bottom, and therefore the paper broke falls from them by the effect of gravity onto the broke conveyor 41 placed underneath or directly into the pulpers 40*a*,40*b*. Also, the modules $M_1$, $M_2$ and $M_3$ are open or openable towards the bottom so that the paper broke falls out of connection with them, substantially by the effect of gravity, without major manual operations, onto the broke conveyor 41 placed underneath.

Underneath the modules $M_1$, $M_2$ and $M_3$, above the floor level $K_2$—$K_2$ of the basement space KT, there is still space KTo for various devices, such as ducts through which the heating medium, such as heated air or steam, is passed into the interior of the hoods 35 of the modules $M_1$, $M_2$ and $M_3$. The lower space KTo is defined from below by the floor level $K_2$—$K_2$ of the basement space and from above by a partition wall 42 placed below the broke conveyor 41. On the drying units $R_2, \ldots, R_8$, there is an air-conditioned hood 50 in itself known.

FIG. 1B is a more detailed illustration of the impingement-drying/through-drying hood module M in accordance with the invention. As shown in FIG. 1B, the wire 32*a* which runs around the large cylinder 31 is first passed around a reversing cylinder 21*a* aligning with the reversing cylinders 21 in the preceding group $R_{n-1}$ with single-wire draw onto the first contact-drying cylinder 30 in the unit $R_n$, from the first contact-drying cylinder further as a short straight run over the sector b from about 220° to about 280° of the large cylinder 31 onto the second contact-drying cylinder 30 in the group $R_n$ and over this cylinder on a sector of about 90°. After this, the web W follows the face of the cylinder 21 and is transferred as a closed draw onto the drying wire 22 of the next group $R_{n+1}$. The hood of the large cylinder 31, which comprises two parts or hood halves 35, covers the cylinder substantially over the entire curve sector b of the wire 32*a* and the web W. On the sector b, the web W remains on the wire 32*a* at the side of the outside curve, i.e., so that its outer face is free or exposed. The large cylinder 31 is mounted on its axle journals 36, through which a communication is arranged with vacuum devices (not shown), by means of which a suitable vacuum is produced in the interior of the cylinder 31, the vacuum being of an order of po from about 1 kPa to about 3 kPa. This vacuum po keeps the web W on the wire 32*a* when the web W is at the side of the outside curve and, at the same time, the vacuum po also promotes possible through-drying taking place through the web W and the wire 32*a*. The sector 360°-b that remains outside the sector b on the large cylinder is covered by a sealing arrangement such as a cover plate 34 placed in the gap between the drying cylinders 30, and also, the reversing cylinder of the group $R_n$, which can also be called the last cylinder 21*a* in the group $R_n$, is covered by an obstacle plate 29. In a more detailed embodiment, the perforated and grooved outer mantle of the large cylinder 31 is, for example, similar to that described in FI 931263 and illustrated above all in FIG. 11 thereof, so that the construction is not described again herein.

The large cylinder 31 is mounted by means of its axle journals 36 on support of a frame construction 37. In this frame construction, both at the driving side and at the tending side, there are horizontal and machine direction frames or beams 37*a*, on whose top face, or on rails provided on the top face, the hood halves 35 are arranged to be movable on wheels 39, which hood halves are illustrated in the open position 35*a*, in which the module M can be serviced. The hood halves 35 are displaced into the open and closed positions by actuating means such as cylinders 38. The module M and its hood 35 are open towards the bottom so that broke can be removed in the direction of the arrows WA substantially by the effect of gravity onto the broke conveyor 41 placed underneath without substantial manual operations, also when the hood halves 35 are in the closed position. The top face of the hood half 35 has been shaped as smoothly, downwardly inclined so as to improve the removal of broke.

Further, in the open position 35*a* of the hood 35, the module M can also be serviced and cleaned easily in other respects. The diameter $D_1$ of the large cylinder 31 is selected to be greater than about 2 m, generally in the range of from about 2 m to about 8 m, preferably from about 2 m to about 4 m. The diameter $D_2$ of the drying cylinders 30 in the group $R_n$ is selected in the range of from about 1.5 m to about 2.5 m, preferably in the range of from about 1.8 m to about 2.2 m. In the groups $R_{n-1}$ and $R_{n+1}$ with single-wire draw, the diameter of the drying cylinders 20 is preferably about the same as the diameter $D_2$. The diameter $D_3$ of the reversing suction cylinders 21,21*a* is selected in a range of from about 0.6 m to about 1.8 m, preferably from about 1.0 m to about 1.5 m.

The wire 32*a* guide roll 33*a* placed above the latter drying cylinder 30 can be stationary or displaceable. Between the groups $R_{n-1}$, $R_n$ and $R_{n+1}$, a small difference in speed is employed, which is generally about 0.1% to about 0.2%, so that, in particular in the initial end of the dryer section on the wires 22,32*a*,22, the speed becomes higher when the web W moves forwards. In the final end of the dryer section, the speed can also be reversed.

Figure 3:
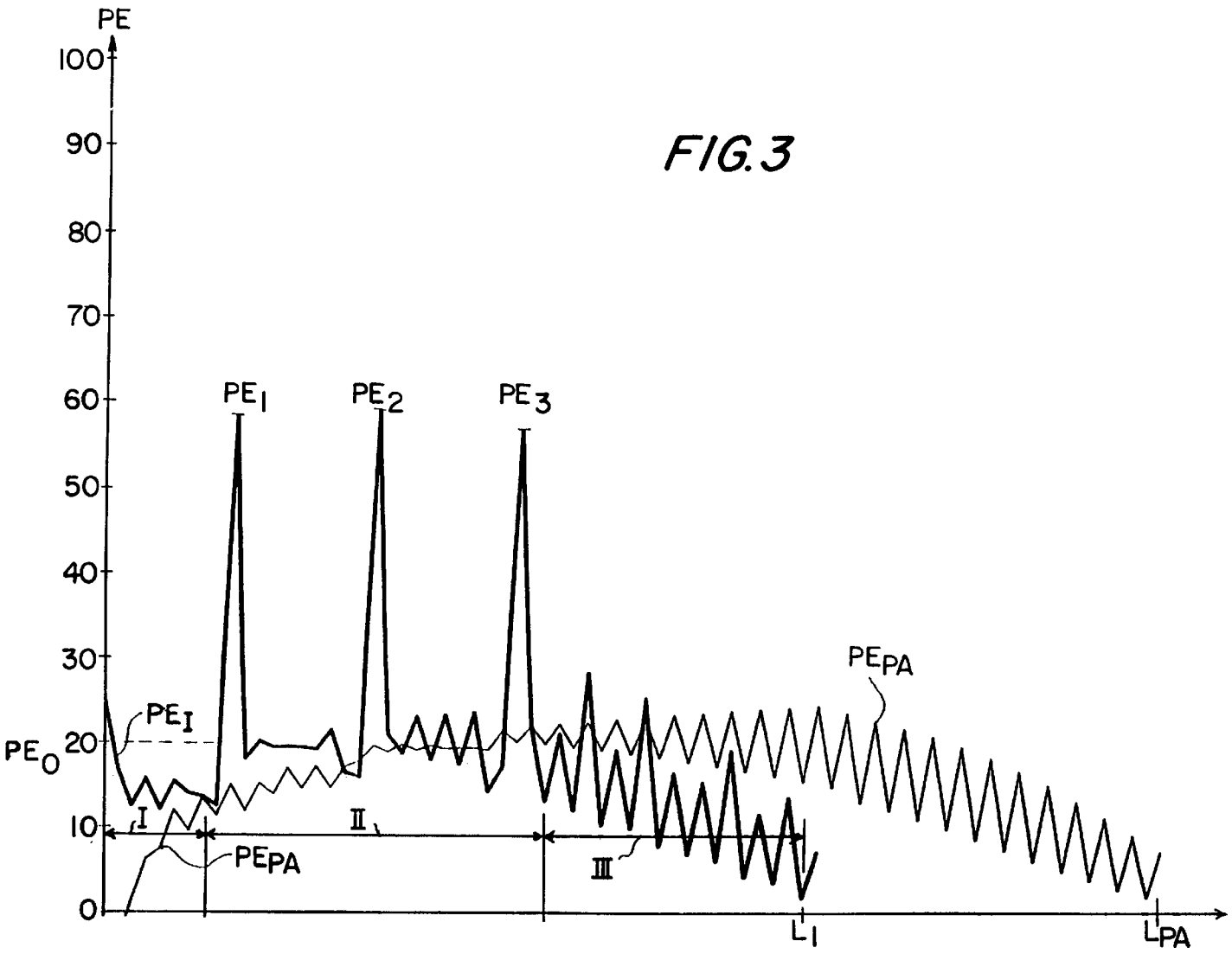
FIG. 3 is a graphic illustration similar to FIG. 2 of the drying method in accordance with the invention and a prior art drying method in a system of coordinates of evaporation capacity-length of the dryer section in the machine direction.

Additional details of the construction of the hood 35 of the module M and the circulation arrangements of the drying gases that are blown through it are described in detail in Finnish Patent Application No. 971713, especially FIG. 3 therein and the related description thereof in the specification.

Figure 1C:
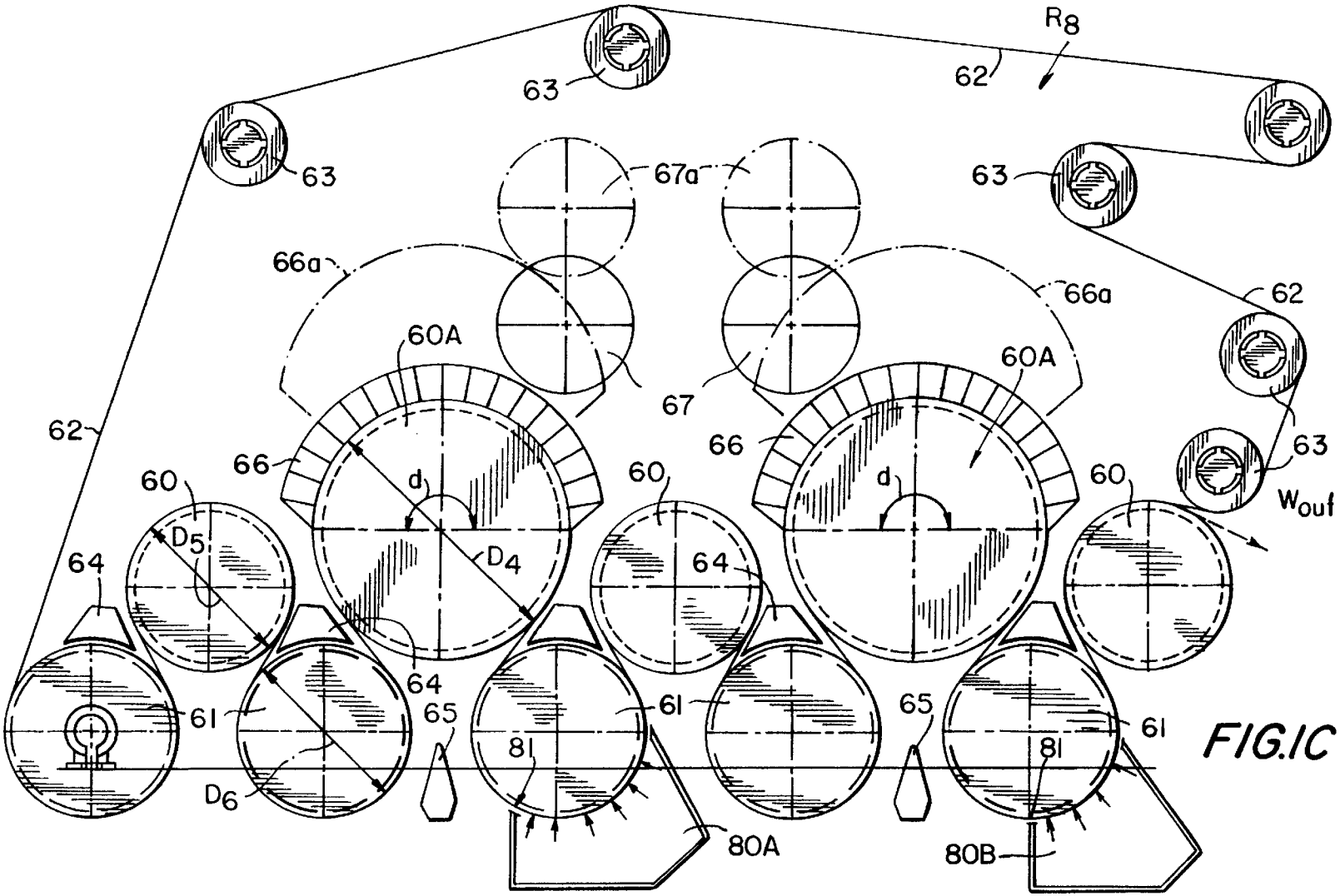
FIG. 1C shows the last wire group of the dryer section in a scale larger than FIG. 1A, in which group the stage III of the method in accordance with the invention is carried out.

FIG. 1C shows, in a larger scale than FIG. 1A, the last group $R_8$ with single-wire draw in the dryer section in accordance with the invention, in which group the third stage of the invention is carried out. The paper web W to be dried is brought into the group $R_8$ from the last contact-drying cylinder 30 of the module $M_3$ shown in FIG. 1A as a closed draw onto the first reversing suction roll 61 of the group $R_8$. There are five of these reversing suction cylinders inside the wire loop 62 in the group $R_8$. The group $R_8$ includes five contact drying cylinders 60,60A. Thus, the drying wire 62 is guided to press the web into direct contact with contact drying cylinders 60,60A, which are heated. Two middle or intermediate ones 60A of these cylinders are contact drying cylinders whose diameter, which is larger than that of the other cylinders 60, is $D_4$ from about 1.8 m to about 2.5 m, whereas the diameter $D_5$ of the smaller cylinders 60 is from about 1.0 m to about 1.8 m, and the diameter $D_6$ of the reversing suction cylinders 61 is from about 1.0 m to about 1.5 m. Between the reversing suction cylinders 61, there are blowing devices 65 to ventilate the spaces between the cylinders 60,60A and 61 and to promote the drying. There is a blow box 64 above the upper sectors of the reversing suction cylinders 61 free from the web W and from the wire 62, which promotes maintenance of the vacuum inside cylinders 61.

Figure 4:
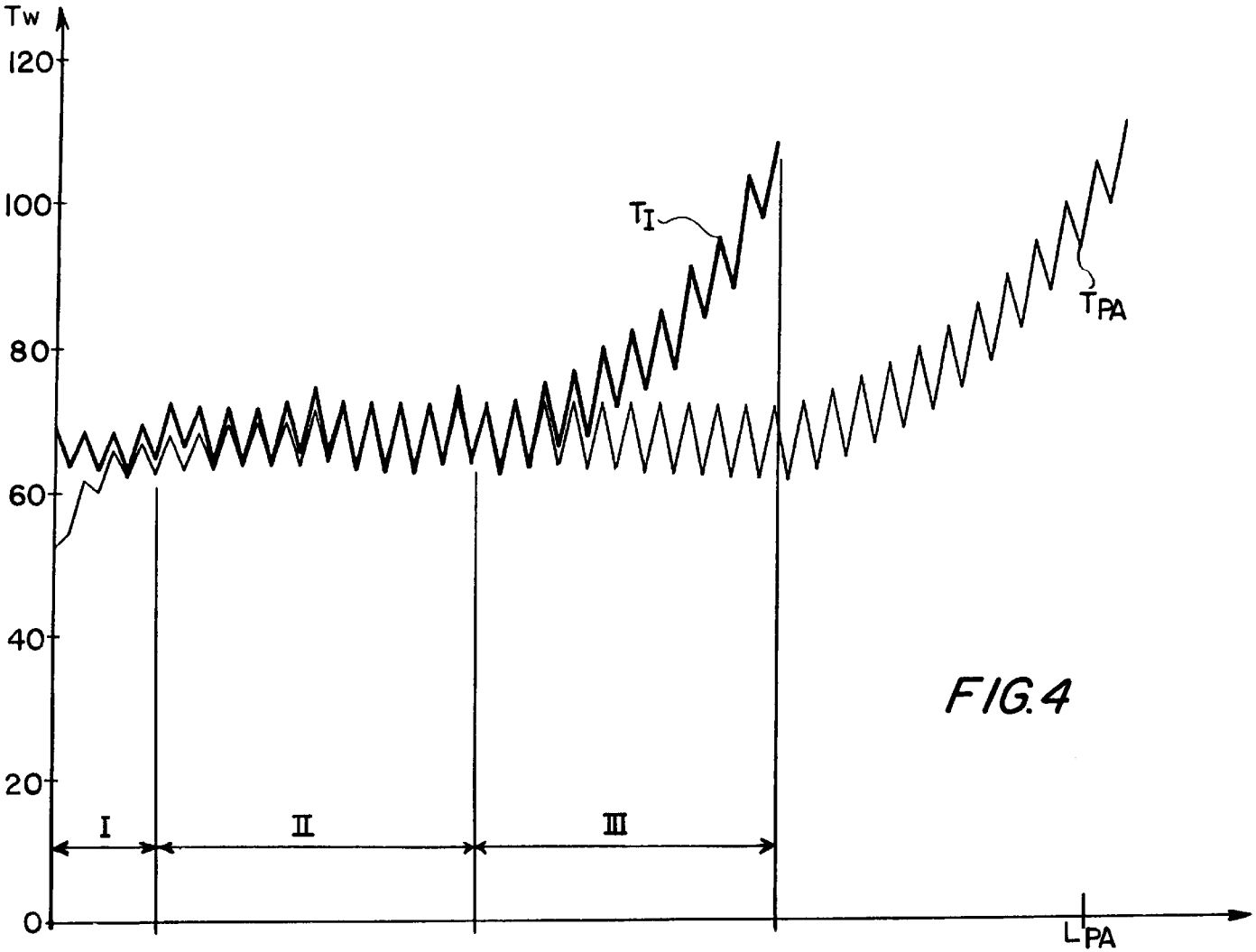
FIG. 4 is an illustration similar to FIGS. 2 and 3 of the distribution of paper web temperature in the machine direction of the dryer section.

In order that it should be possible to carry out the stage III of the method in accordance with the invention and to achieve a sufficiently high evaporation capacity and an increase in the web W temperature Tw in accordance with the curve T1 of FIG. 4, by means of the group $R_8$ shown in FIG. 1C, a drying effect is applied to the web W by means of contact drying cylinders 60A with large diameter also from the top face of the web W, i.e., from the side of the drying wire 62. For this purpose, ventilation hoods 66 are provided above the cylinders 60A, into which hoods sufficiently hot and dry drying air gases are passed through an intake pipe 67. Out of the pressurized interior of the ventilation hoods 66, the humidified ventilation air is discharged into the hood 50 around the dryer section, from where it is removed in a way known from the prior art. These drying gases are blown against the drying wire 62 on the sector d of the cylinders 60A, this sector being preferably about 180° or even larger, i.e., gas flows are directed at the web through the drying wire 62 as the drying wire 62 carries the web over the cylinders 60A. Thus, evaporation of water is promoted through the upper face of the web W through the wire 62. The ventilation hoods 66 are shown in their open position 66*a*, as well as their air intake pipes are shown in their open position 67*a*. In the open position 66*a*, it is possible to clean and service the ventilation hoods, and the web W threading is also carried out most favorably then. In respect of their construction, the ventilation hoods 66 can be similar to those that are described in more detail in Finnish Patent Application No. 971713.

FIG. 1C shows blow hoods 80A and 80B arranged below the reversing suction cylinders 61 placed after the contact drying cylinders 60A. The edges of these blow hoods 80A and 80B to be placed against the free bottom face of the paper web (W) to be dried, both the cross direction edges 81 and the machine-direction end edges, are provided with sufficiently small gaps in order to minimize escaping of the drying air. By means of the blow hoods 80A and 80B, impingement drying is applied to the web W that runs over the reversing suction cylinders 61 on the outer face of the drying wire 62 on a considerably large sector, whose magnitude is, for example, from about 60° to about 180°. By means of this impingement drying, for its part, it is ensured that the sufficiently high rate of evaporation, which is higher than what is conventional and which is required by the stage III in the method in accordance with the invention, can be accomplished. The impingement hoods 80A and 80B are not indispensable in all embodiments, and they can be employed in connection with one or more and, if necessary, with more than two reversing suction cylinders 61 or equivalent.

With respect to the various details of the construction and the operation of the ventilation hoods 66, reference is made to the current assignee's Finnish Patent Application No. 951746 and Finnish Patent No. 83,679 of Teollisuusmittaus Oy.

Figure 1D:
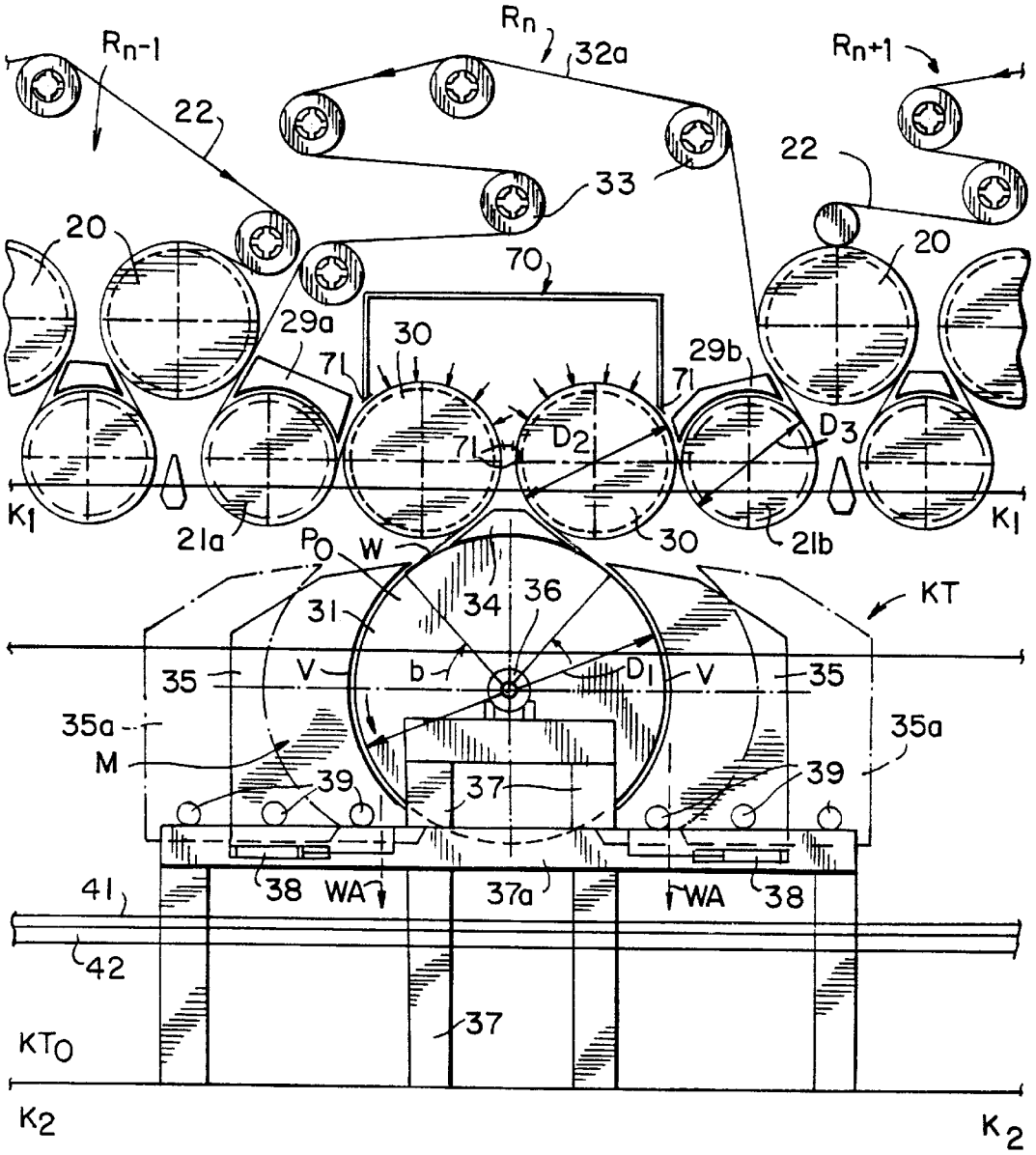
FIG. 1D shows a variation of a dryer section substantially similar to the dryer section illustrated in FIG. 1B.

FIG. 1D shows a variation of an impingement-drying/through-drying module similar 10 to that shown in FIG. 1B. In the following, the differences between the embodiments shown in FIGS. 1B and 1D only will be described, and in other respects the construction shown in FIG. 1D is similar to that shown in FIG. 1B. As shown in FIG. 1D, onto the contact drying cylinders 30, a blow hood 70 is arranged to cover the successive contact drying cylinders 30 across the whole of their axial length and in the machine direction, for example, on a sector of about 90° to about 180°. Both the cross direction edges 71 and the machine-direction end edges of the blow hood 70, to be placed against the wire 32*a*, are provided with sufficiently small gaps in order to minimize escaping of the drying air. By means of the blow hood 70, an air blowing which dries the web is applied through the wire 32*a* to the web W that runs over the contact drying cylinders 30. By means of this blowing, it is partly ensured that the sufficiently high evaporation rate, which is generally higher than conventional and which is required by the stages II and/or III in the method in accordance with the invention, is achieved. In such a case, at the same time, both impingement drying takes place straight and directly against the web W and through-drying takes placed by means of the hood 70 through the wire.

In the embodiment shown in FIG. 1D, the impingement drying is carried out by means of the large cylinder 31 and, if necessary, also by means of the impingement drying hoods 80A and 80B shown in FIG. 1C, or equivalent. Also, the wire 32*a* of the unit $R_n$ has been passed over the former and the latter reversing suction rolls 21*a* and 21*b*. On the free sectors of both of these reversing suction rolls 21*a* and 21*b*, there are obstacle plates or boxes 29*a* and 29*b*. Thus, on the wire 32*a* of the unit $R_n$, the web W is passed from the last drying cylinder 20 in the preceding unit $R_{n-1}$ onto the first drying cylinder 20 in the latter unit $R_{n+1}$ as a fully closed draw.

Figure 2:
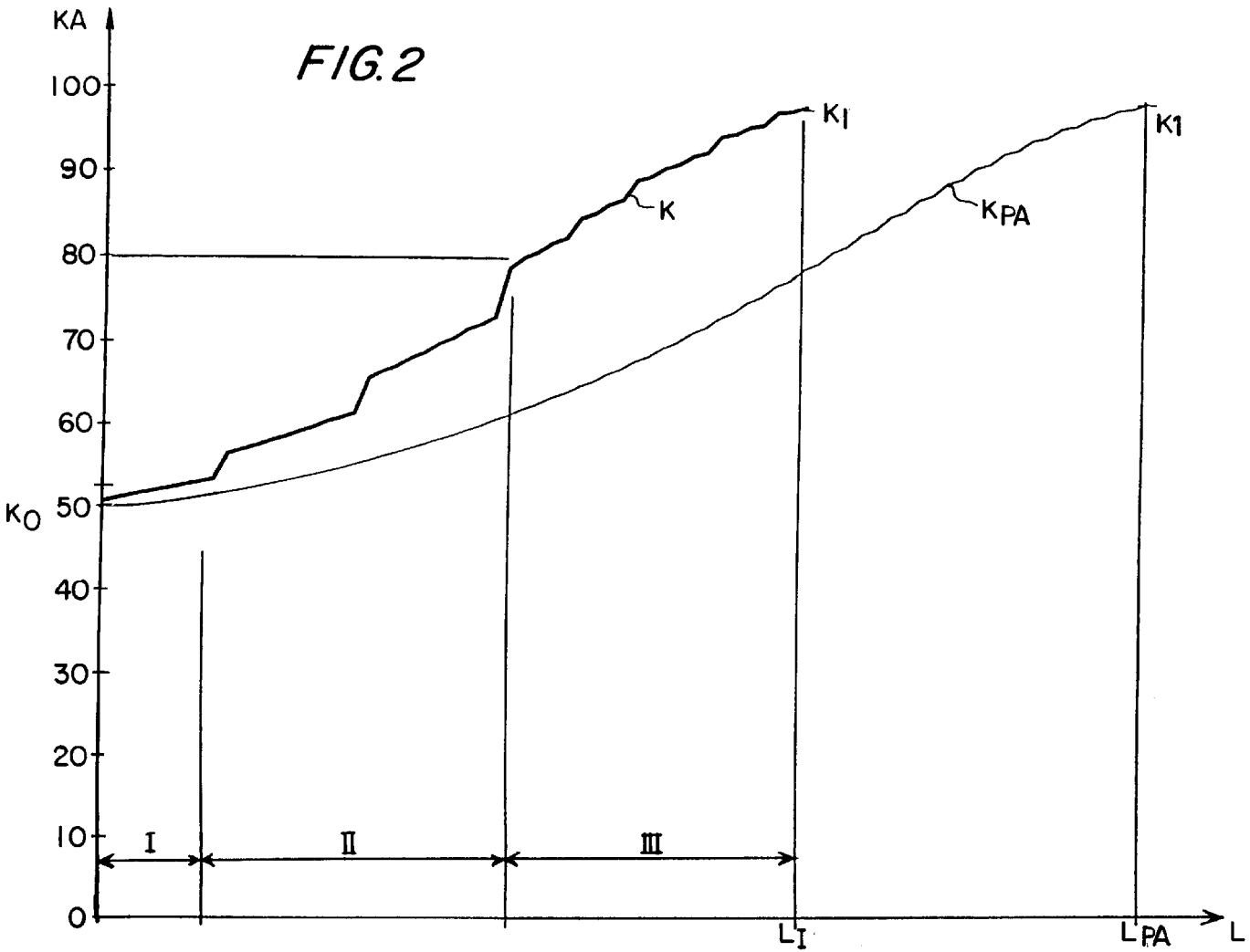
FIG. 2 is a graphic illustration of the different stages of the method in accordance with the invention in a system of coordinates of dry solids content of the web-length of the dryer section in the machine direction, compared with a prior art multi cylinder dryer.

FIG. 2 shows the development of the dry solids content KA of the paper over the length L of the dryer section in the machine direction as a function. The curve K represents an optimized method in accordance with the invention, and the curve $K_{PA}$ represents the development of the dry solids content with a method and a dryer section of prior art. The curves K and $K_{PA}$ have been obtained by means of computer simulation using the current assignee's dryer section process model. The basis for the curve $K_{PA}$ is the current assignee's prior art SymRun™ dryer section concept, which consists of N pcs. of successive groups with single-wire draw that are open towards the bottom, and the curve K is based on a dryer section concept in accordance with FIG. 1A.

It can be noticed immediately from FIG. 2 that it has been possible to shorten the length of the dryer section from the length $L_{PA}$ to the length $L_I$, i.e., in practice by about 15% to 40%. In accordance with FIGS. 1–4, the method in accordance with the invention is divided into three different stages I, II and III. As shown in FIG. 2, in the first stage I the rate of increase in dry solids content KA of the web W becomes higher from the initial value K0 more steeply in accordance with the curve K, in comparison with the curve $K_{PA}$, because the initial temperature of the web W is higher, which becomes clear from a comparison of the temperature curves $T_I$ and $T_{PA}$ of the stage I. Also, in the first stage I, as is shown in FIG. 3, the evaporation efficiency PE is, in accordance with the curve $PE_I$, substantially higher than in the prior art method, curve $PE_{PA}$ of stage I (FIG. 3). In the invention, the first phase I is carried out on a horizontal dryer unit $R_1$ where the web W temperature Tw is raised to about 55° C. to about 85° C., preferably to about 70° C., as comes out from FIG. 4. In the invention, this increase in the temperature can be carried out very quickly because in the unit $R_1$ a highly energy-intensive impingement stage and/or infra radiation can be used, because heating of the web W takes place free of contact so that there is no risk of sticking.

Stage II, shown in FIGS. 1A–4, is the main evaporation area where, in accordance with FIG. 2, the dry solids content KA of the web increases more steeply than in stage I as the drying proceeds. FIG. 3 shows the three successive evaporation peaks $PE_1$, $PE_2$ and $PE_3$ of stage II, at which the maximal evaporation efficiency PE is of an order of from about 60 kg/m$^2$/h (kilograms per square meter in an hour). These evaporation peaks are achieved by the hood modules $M_1$, $M_2$ and $M_3$ in the dryer section shown in FIG. 1A. Depending on the mode of operation of the modules $M_1$, $M_2$ and $M_3$ or equivalent, the maximal evaporation efficiency can be even higher. Between the peaks $PE_1$, $PE_2$ and $PE_3$, the evaporation efficiency PE is of an order 20 kg/m$^2$/h, i.e., of the same order of magnitude as the evaporation efficiency in accordance with the curve $PE_{PA}$ in FIG. 3 on the average.

In the exemplifying embodiment of FIG. 4, the web temperature Tw stays substantially invariable in the stage II in accordance with the curves $T_I$ and $T_{PA}$ in a range of about 60° C. to about 70° C. As stated above, the stage II is the main evaporation area where the water is evaporated from between the fibers in the web W and from the fibre surfaces.

In the third stage III in accordance with the invention, the steepness of the increase in the dry solids content decreases in comparison with stage II. The evaporation efficiency also decreases in accordance with FIG. 3, whereas the web W temperature Tw starts rising from about 70° C. to between about 100° C. and about 110° C. In the corresponding location in the dryer section in the machine direction, in prior art methods, the evaporation efficiency still remains substantially constant in accordance with the curve $PE_{PA}$ in FIG. 3, and so also the temperature in accordance with the curve $T_{PA}$ in FIG. 4. In the dryer section in accordance with the invention, the stage III is carried out in the last cylinder group $R_8$, where the evaporation is made more intensive by means of the hoods 66 that are placed above the cylinders 60 A with large diameter. In the hoods 66, sufficiently powerful and hot drying gases are applied to the web W placed under the drying wire 62 and to the environment of the wire 62 so that the web W temperature Tw can be raised very steeply in the stage III, in accordance with FIG. 4, in which connection also the water present inside the fibers in the paper web W can be evaporated efficiently on a sufficiently short length L of the dryer section in the machine direction.

Figure 5:
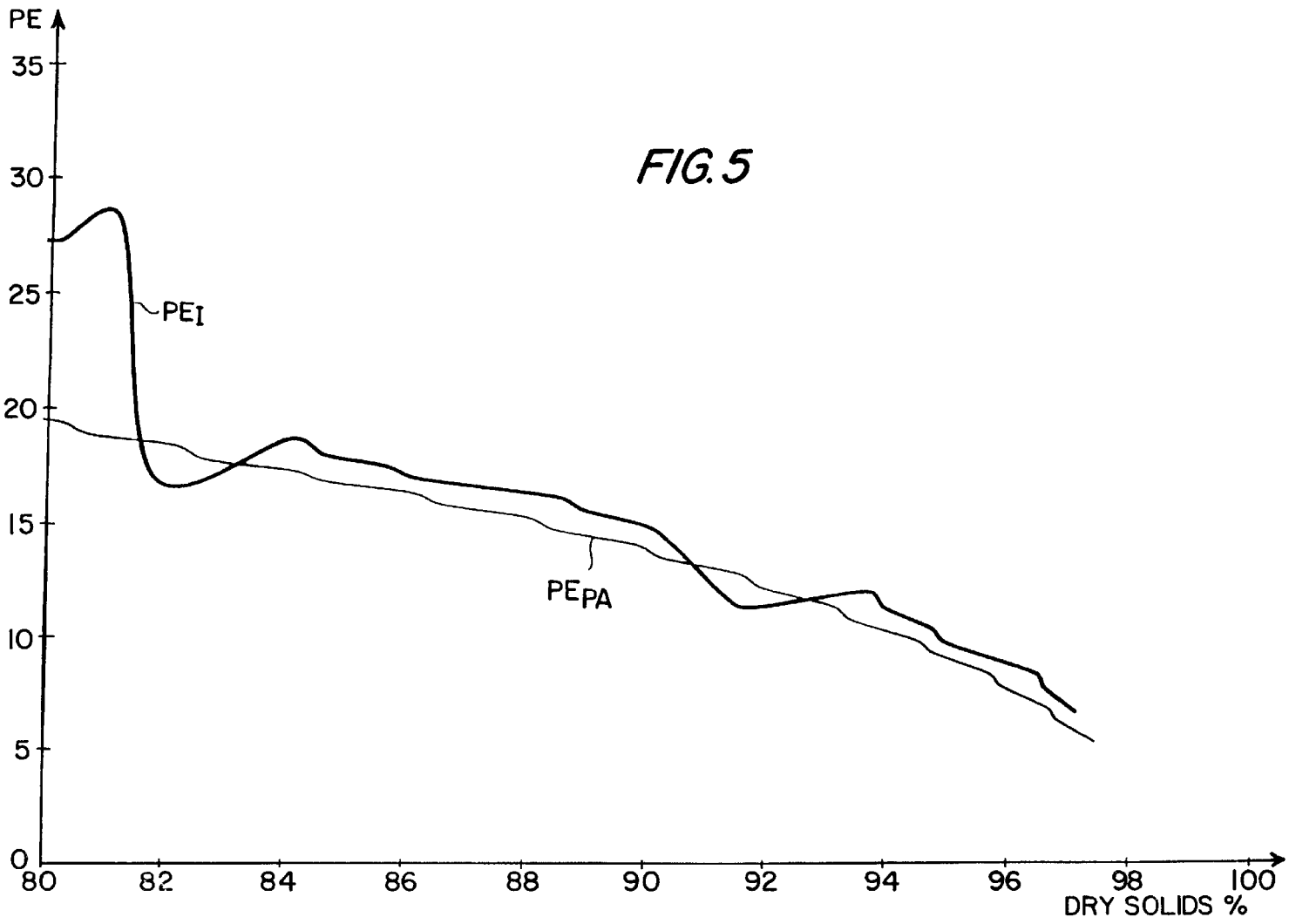
FIG. 5 illustrates the evaporation capacity of stage III in accordance with the invention as a function of the dry solids content percentage of the web in the method in accordance with the invention and in a prior art dryer section.

FIG. 5 illustrates the evaporation efficiency PE in the stage III of the invention, i.e., the dry solids content KA in the area from about 80% to about 98%. The curve $PE_I$ represents the method in accordance with the invention, and the curve $PE_{PA}$ a corresponding curve carried out by means of the prior art SymRun™ concept. FIG. 5 shows that in the beginning of the stage III, in accordance with the curve $PE_I$, in the dry solids content area from about 80% to about 82%, the evaporation efficiency is substantially higher than in the prior art concept and somewhat higher than in the dry solids content area from about 84% to about 91% and in the dry solids content area from about 93% to about 98%. This improvement has mainly been carried out in the particular group $R_8$ by means of the drying cylinders 60A with large diameter and by means of the blowings from their ventilation hoods 66. Thus, in the drying method and in the dryer section in accordance with the invention, the ultimate dry solids content of the web W, k1 from about 96% to about 98%, is achieved in the machine direction length $L_I$ of the dryer section, whereas in the prior art, a substantially longer length $L_{PA}$ was needed.

In view of the foregoing and especially from FIG. 1A, the method stage I in accordance with the invention is carried out by applying drying energy mainly through the upper face of the web W. As shown in FIG. 1A, in the second stage II of the method, drying energy is applied to the web mainly through the lower face of the web only by means of the wire groups $R_3$, $R_4$, $R_5$, $R_6$, $R_7$ and $R_8$ and by means of the hood modules $M_1$, $M_2$ and $M_3$, whereas in the group $R_8$ (FIG. 1C) and in the stage III drying energy is applied to the web W through its both faces by applying drying energy through the lower face of the web W by means of the contact drying cylinders 60 and 60A and through the upper face of the web by means of the ventilation hoods 66 on the sectors d of the cylinders. This arrangement provides a short dryer section in which, at the same time, it is possible to control the paper quality, for example its curl.

In this context it should be emphasized that the method in accordance with the invention can also be carried out with many other dryer section concepts and solutions of equipment besides those of FIGS. 1A and 1B. Examples of these other dryer section concepts are some dryer section concepts described in the current assignee's Finnish Patent Applications Nos. 971713 and 971715. It is an important feature of the dryer section in accordance with the invention that in the different drying stages I, II and III, equipment is used by means of which it is possible to carry out heating of the web and evaporation in accordance with the invention optimally. This inevitably has the consequence that, unlike the prior art, in the different stages I, II and III of the invention, arrangements of equipment different from one another have to be used, which is illustrated in FIG. 1A.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A method for evaporation drying a paper web having a dry solids content from about 35% to about 55% until the web has a dry solids content from about 90% to about 98%, comprising the steps of:

passing the web through three successive stages in a running direction of the web as follows:

in the first stage, passing the web through a short section in the machine direction and rapidly heating the web in the short section to a temperature from about 55° C. to about 85° C., in the second stage, drying the web utilizing an evaporation efficiency and rate of increase in dry solids content per unit of length of the dryer section in the machine direction which are higher than in the first stage or in the third stage and such that the temperature of the web does not rise substantially in the second stage, and in the third stage, continuing drying of the web with a decreasing evaporation efficiency and an average rate of increase in the dry solids content of the web in the machine direction which is lower than the rate of increase in the dry solids content of the web in the second stage.

2. The method of claim 1, wherein the step of heating the web in the first stage comprises the step of applying an energy-intensive heating effect of at least one of a drying gas and electromagnetic radiation to the web without contacting the web.

3. The method of claim 1, wherein the step of evaporation drying the web in the second stage comprises the step of applying evaporation efficiency peaks to the web to improve the evaporation of water from between fibers in the web and from fiber surfaces, the evaporation efficiency peaks being substantially higher than the evaporation efficiency applied to the web in the second stage between the evaporation efficiency peaks.

4. The method of claim 1, wherein the step of drying the web in the third stage comprises the steps of contact drying the web by passing the web on a drying wire into direct contact with heated drying cylinders and applying drying gas flows to the web through the drying wire during the contact drying of the web.

5. The method of claim 1, wherein the step of evaporation drying the web in the second stage comprises the step of applying evaporation power peaks to the web having a maximum evaporation efficiency from about 50 to about 90 $kg/m^2/h$.

6. The method of claim 1, wherein the step of evaporation drying the web in the second stage comprises the step of evaporation drying the web until the dry solids content is increased from about 50% to about 80%.

7. The method of claim 1, wherein the step of evaporation drying the web in the second stage comprises the step of applying at least one evaporation efficiency peak to the web, each of the at least one evaporation efficiency peak being higher than the evaporation efficiency applied in the second stage between the evaporation efficiency peaks, each of the at least one evaporation efficiency peak being obtained by directing energy-intensive drying gas jets into contact with the web as the web runs through one of an impingement drying unit and a through-drying unit situated between a pair of contact drying cylinders and in a basement space below a floor level of the dryer section.

8. The method of claim 1, wherein the step of drying the web in the third stage comprises the steps of:

passing the web into direct contact with heated contact drying cylinders, and regulating the evaporation rate by increasing a relative proportion of the contact of the web with the contact drying cylinders.

9. The method of claim 1, wherein the step of drying the web in the third stage comprises the steps of:

supporting the web on a drying wire, guiding the drying wire to press the web into direct contact with heated contact drying cylinders, and directing gas flows at the web through the drying wire as the drying wire carries the web over at least one of the contact drying cylinders.

10. The method of claim 1, wherein the step of drying the web in at least one of the second and third stages comprises the steps of:

passing the web through at least one single-wire draw group, and applying both impingement drying and through-drying of the web through a wire.

11. The method of claim 1, wherein the step of heating the web in the first stage comprises the step of:

applying drying energy to the web mainly through its upper face;

the step of drying the web in the second stage comprises the step of:

applying drying energy to the web through its lower face; and the step of heating the web in the third stage comprises the step of:

applying drying energy to the web through both its upper and lower faces.

12. A dryer section of a paper machine, comprising a first drying wire unit arranged to receive a web from a press section preceding the dryer section, said first drying unit comprising at least one of blow boxes and radiation dryer units for heating the web in a first stage without contacting the web, the web being passed in said first drying unit through a short section in the machine direction and rapidly heated in the short section to a temperature from about 55° C. to about 85° C., and additional dryer units arranged after said first drying unit in the running direction of the web, said additional dryer units comprising at least one group with single-wire draw including contact drying cylinders arranged in a first row and reversing suction cylinders arranged in a second row below said first row of contact drying cylinders, a first set of said additional dryer units being arranged to evaporation dry the web in a second stage utilizing an evaporation efficiency and rate of increase in dry solids content per unit of length of the dryer section in the machine direction which are higher than in the first stage and such that the temperature of the web does not rise substantially in the second stage, and a second set of said additional dryer units arranged after said first set of additional dryer units and being arranged to continue drying the web in a third stage with a decreasing evaporation efficiency and an average rate of increase in the dry solids content of the web in the machine direction which is lower than the rate of increase in the dry solids content of the web in the second stage.

13. The dryer section of claim 12, wherein said second set of additional dryer units comprises said at least one single-wire draw group, said at least one single-wire draw group including a hood arranged to increase evaporation through the wire and extending above at least one of said contact drying cylinders in said at least one single-wire draw group.

14. The dryer section of claim 12, wherein said second set of additional dryer units comprises said at least one single-wire draw group, said at least one single-wire draw group including a hood arranged to increase evaporation through the wire and extending above a first one of said contact drying cylinders in said at least one single-wire draw group, said first one of said contact drying cylinders having a diameter larger than a diameter of at least a second one of said contact drying cylinders in said at least one single-wire draw group.

15. The dryer section of claim 12, wherein said additional dryer units comprise at least two of said single-wire draw groups, further comprising a drying module arranged between said single-wire draw groups, said drying module comprising a drying wire guided in a loop, a large-diameter cylinder arranged in said loop of said drying wire, said drying wire being guided over said large-diameter cylinder such that a contact sector of said drying wire over said large-diameter cylinder is greater than about 180°, said large-diameter cylinder being selected from a group consisting of an impingement-drying cylinder and a through-drying cylinder, a blow hood arranged around said large-diameter cylinder and having an open position and a closed position, and a pair of heated contact-drying cylinders having a diameter smaller than a diameter of said large-diameter cylinder, each of said pair of contact-drying cylinders being situated on a respective side of said large-diameter cylinder at least one of above said large-diameter cylinder and proximate said large-diameter cylinder.

16. The dryer section of claim 15, wherein the paper machine is situated in a paper machine hall having a floor level, said large-diameter cylinder in said drying module being arranged below the floor level of the paper machine hall, said contact drying cylinders of said single-wire draw groups being arranged such that the central axes of said contact drying cylinders are situated above said large-diameter cylinder in said drying module and above the floor level of the paper machine hall.

17. The dryer section of claim 16, further comprising a broke conveyor arranged underneath said single-wire draw groups and said blow hood of said drying module such that while in the hood open position, the removal of broke from said blow hood takes place by the force of gravity onto said broke conveyor.

18. The dryer section of claim 12, wherein said first set of additional dryer units comprises first, second and third single-wire draw groups and said second set of additional dryer units comprises at least one single-wire draw group, further comprising first, second and third drying modules each comprising a drying wire guided in a loop, a large-diameter cylinder arranged in said loop of said drying wire, said drying wire being guided over said large-diameter cylinder such that a contact sector of said drying wire over said large-diameter cylinder is greater than about 180°, said large-diameter cylinder being selected from a group consisting of an impingement-drying cylinder and a through-drying cylinder, a blow hood arranged around said large-diameter cylinder and having an open position and a closed position, and a pair of heated contact-drying cylinders having a diameter smaller than a diameter of said large-diameter cylinder, each of said pair of contact-drying cylinders being situated on a respective side of said large-diameter cylinder at least one of above said large-diameter cylinder and proximate said large-diameter cylinder, said first drying module being arranged after said first single-wire draw group, said second single-wire draw group being arranged after said first drying module, said second drying module being arranged after said second single-wire draw group, said third single-wire draw group being arranged after said second drying module, said third drying module being arranged after said third single-wire draw group, said at least one single-wire draw group of said second set of additional dryer units being arranged after said third drying module, said at least one single-wire draw group including a hood arranged extending above a first one of said contact drying cylinders in said at least one single-wire draw group, said first one of said contact drying cylinders having a diameter larger than a diameter of at least a second one of said contact drying cylinders in said at least one single-wire draw group.

19. The dryer section of claim 12, further comprising at least one hood for one of through-drying and impingement-drying arranged in connection with at least one of said contact drying cylinders in said at least one single-wire draw group.

20. The dryer section of claim 12, further comprising at least one impingement-drying hood arranged in connection with at least one of said contact drying cylinders in said at least one single-wire draw group, and further comprising at least one through-drying hood arranged in connection with at least one of said contact drying cylinders in said at least one single-wire draw group.

* * * * *